US010037880B2

(12) United States Patent
Ermakov et al.

(10) Patent No.: US 10,037,880 B2
(45) Date of Patent: Jul. 31, 2018

(54) ELECTROSTATIC ION TRAP MASS SPECTROMETER UTILIZING AUTORESONANT ION EXCITATION AND METHODS OF USING THE SAME

(71) Applicant: Rutgers, The State University of New Jersey, New Brunswick, NJ (US)

(72) Inventors: Alexei Ermakov, Piscataway, NJ (US); Barbara J. Hinch, Piscataway, NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 0 days.

(21) Appl. No.: 15/124,378

(22) PCT Filed: Mar. 13, 2015

(86) PCT No.: PCT/US2015/020326
§ 371 (c)(1),
(2) Date: Sep. 8, 2016

(87) PCT Pub. No.: WO2015/138826
PCT Pub. Date: Sep. 17, 2015

(65) Prior Publication Data

US 2017/0018418 A1 Jan. 19, 2017

Related U.S. Application Data

(60) Provisional application No. 61/952,958, filed on Mar. 14, 2014.

(51) Int. Cl.
*H01J 49/00* (2006.01)
*H01J 49/42* (2006.01)

(52) U.S. Cl.
CPC ..... *H01J 49/4245* (2013.01); *H01J 49/0031* (2013.01)

(58) Field of Classification Search
CPC ..... H01J 49/00; H01J 49/0031; H01J 49/4245
(Continued)

(56) References Cited

U.S. PATENT DOCUMENTS 5,187,365 A 2/1993 Kelley
8,586,918 B2 11/2013 Brucker et al.
(Continued)

OTHER PUBLICATIONS

Ermakov, A.V. et al., "An electrostatic autoresonant ion trap mass spectrometer", Rev. Sci. Instrum., 81: 013107 (2010).
(Continued)

*Primary Examiner* — Nicole Ippolito
*Assistant Examiner* — Hanway Chang
(74) *Attorney, Agent, or Firm* — Kathleen D. Rigaut; Dann, Dorfman, Herrell & Skillman

(57) ABSTRACT

Methods of operation of electrostatic ion trap mass spectrometers in which ions are autoresonantly driven at selected higher integer (>2) multiples of ion oscillation frequencies are provided. Excitation at multiples higher than the fundamental or double the fundamental ion oscillation frequency significantly improves both signal intensity and mass resolution. Each method allows excitation exclusively at one selected frequency that is an integer multiple of an ion's natural oscillation frequency, and thereby virtually eliminates ion excitation at unwanted harmonic frequencies. The resultant mass spectra are therefore clean, and do not display spectral features associated with rf excitation at unintended multiple harmonic frequencies. This has been demonstrated explicitly for 4× and 6× modes, and it is fully implementable at any odd or even multiples of ion oscillation frequencies. With implementation of a new method, mass spectrometers can be operated at faster mass scan rates, giving faster response times, without degradation of signal to noise or resolution over the existing technology instruments. Equivalently, with implementation of a new method, mass spec-
(Continued)

trometers can be operated with superior signal to noise ratios without degradation of response times or resolution.

21 Claims, 6 Drawing Sheets

(58) Field of Classification Search
USPC ..... 250/281, 282, 283
See application file for complete search history.

(56) References Cited

U.S. PATENT DOCUMENTS

| | | | |
|---|---|---|---|
| 2005/0263695 | A1 | 12/2005 | Syka |
| 2009/0114810 | A1 | 5/2009 | Green |
| 2010/0059670 | A1 | 3/2010 | Schwartz |
| 2011/0251801 | A1 | 10/2011 | Misharin et al. |
| 2011/0290995 | A1 | 12/2011 | Kumph |
| 2012/0112056 | A1 | 5/2012 | Brucker et al. |
| 2014/0061457 | A1 | 3/2014 | Berdnikov et al. |

OTHER PUBLICATIONS

Ermakov, A.V. et al., "Trajectory compensation in an autoresonant trap mass spectrometer", J. Mass Spectrometry, 46: 672-676 (2011).
Brucker et al., "Autoresonant Trap Mass Spectrometry (ART MS) for remote sensing applications", Int. J. Mass Spectrometry, 295: 133-137 (2010).
International Search Report and Written Opinion, dated Jun. 17, 2015, issued in corresponding International Application No. PCT/US2015/020326.

ELECTROSTATIC ION TRAP MASS SPECTROMETER UTILIZING AUTORESONANT ION EXCITATION AND METHODS OF USING THE SAME

CROSS-REFERENCE TO RELATED APPLICATIONS

This application is a § 371 of International Application No. PCT/US2015020326, filed Mar. 13, 2015, which claims the benefit of U.S. Provisional Application No. 61/952,958, filed Mar. 14, 2014. The entire disclosure of each of the aforesaid applications is incorporated by reference in the present application.

FIELD OF THE INVENTION

The present invention relates generally to ion trap mass spectrometers and more particularly, but not exclusively, to electrostatic ion trap mass spectrometers that utilize autoresonant ion excitation and methods of operating such spectrometers.

BACKGROUND OF THE INVENTION

Mass spectrometers may be used to detect ions according to their mass-to-charge ratio. Certain spectrometers may trap ions for analysis such as electrostatic ion trap mass spectrometers. Electrostatic ion trap spectrometers may confine ions of different mass-to-charge ratios and kinetic energies within an anharmonic potential well. The amplitudes of oscillation of the confined ions are increased as their energies increase, due to an autoresonance between the AC drive frequency applied and the mass-dependent natural oscillation frequencies of the ions, until the oscillation amplitudes of the ions exceed the physical dimensions of the trap and the mass-selected ions are detected, or the ions fragment or undergo any other physical or chemical transformation.

There is a need in the field for mass spectrometers, including electrostatic ion trap spectrometers, that provide improved signal intensity and mass resolution to allow for faster mass scan rates and instrument response times. The present invention meets these needs.

SUMMARY OF THE INVENTION

The present invention discloses methods of operation for electrostatic ion trap mass spectrometers in which ions may be autoresonantly driven at selected integer multiples of natural ion oscillation frequencies. Excitation multiples greater than twice the fundamental oscillation frequency of subject ions significantly improves both signal intensity and mass resolution.

In one aspect, the present invention provides a mass spectroscopic method utilizing ions having a natural oscillation frequency that are confined within an ion trap.

The method may include the step of confining the ions with an anharmonic confining potential within the ion trap, wherein the ion trap may have at least four electrodes. The method may also include the step of applying at least two AC signals to two or more (e.g., more than two) of the at least four electrodes, wherein the at least two AC signals may be applied at the same instantaneous frequency, at fixed relative phases, and the at least two AC signals may have differing AC signal amplitudes. Additionally, the method may include autoresonantly driving the ions with an AC signal amplitude that may be greater than a threshold value at an integer multiple of the initial natural oscillation frequency and at a frequency less than the integer multiple of the initial natural oscillation frequency. Furthermore, the method may include the step of scanning (e.g., instantaneous frequency scanning) from greater than the integer multiple of the initial natural oscillation frequency to less than the integer multiple of the initial natural oscillation frequency, wherein the integer multiple may be greater than 2.

In another aspect, the present invention may include a mass spectrometer having an ion trap that may have an electrode structure that produces an electrostatic potential in which ions are confined to trajectories at natural oscillation frequencies, wherein the confining potential may be anharmonic.

The device may further include an AC excitation source configured to provide an excitation frequency that excites confined ions at AC frequencies of about N times the natural oscillation frequency of the ions. The AC excitation source may be connected to at least two electrodes by an AC network and may be capable of providing at least two AC signals. The at least two AC signals may have an AC signal amplitude and a fixed relative AC signal phase, and each AC signal may be applied to one of the at least two electrodes. The AC signal amplitudes and the AC signal phases may be selected such that there are Y sections with instantaneously opposing AC electric fields within the ion trap, with each of the Y sections contributing about equal amounts of energy to ion excitation; wherein N is an integer greater than 2 and Y is an integer of at least 2.

The methods and devices of the invention allow for excitation exclusively at one selected frequency that is an integer multiple of an ion's natural or fundamental oscillation frequency, and thereby virtually eliminate ion excitation at unwanted harmonic frequencies. The mass spectra that result from the methods of the invention are therefore clean, and do not display spectral features associated with radio frequency (rf) excitation at unintended multiple harmonic frequencies. These multiples of the natural or fundamental oscillation frequency may be greater than twice the fundamental oscillation frequency, and more preferably, four and six times greater than the fundamental oscillation frequency.

BRIEF DESCRIPTION OF THE DRAWINGS

The foregoing summary and the following detailed description of the exemplary embodiments of the present invention may be further understood when read in conjunction with the appended drawings, in which.

DETAILED DESCRIPTION OF THE INVENTION

Figure 1:
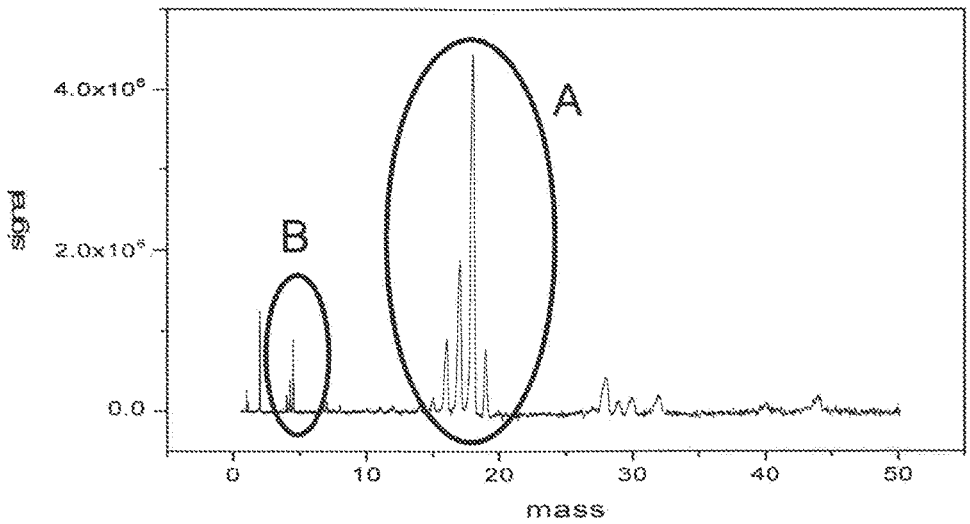
FIG. 1 illustrates a mass spectrum showing the results of autoresonant ion energy excitation with $f_{rf}$ at the fundamental and at twice the fundamental ion oscillation frequency. Ions of masses 16, 17, 18, and 19, (A), appear also to be ejected at ¼ of their actual masses, (B).

Autoresonant ion trap mass spectrometers can utilize linear electrostatic ion traps of cylindrical symmetry. Exemplary electrostatic ion trap spectrometers are disclosed in U.S. Patent Application Publication Nos. 2010/0084549 and 2012/0112056; U.S. Pat. No. 8,586,918; and International Patent Publication Nos. WO2008063497 and WO2010129690, each of which is incorporated herein by reference.

For example, an ion trap may include an electrode structure, including opposing mirror electrodes and a central lens therebetween, that produces an electrostatic potential in which ions are confined to trajectories at natural oscillation frequencies, where the confining potential may be anharmonic as described herein. The ion trap may also include an AC excitation source configured to provide an excitation frequency f that excites confined ions at a frequency of about a multiple of the natural oscillation frequency of the confined ions. Moreover, the AC excitation frequency source may be connected to a lens.

The operation of such mass spectrometers relies on non-uniform electrostatic fields for confinement of ion trajectories near the central axis. The required anharmonicity also implies that if sufficiently high amplitude rf fields are applied within the trap, with decreasing frequency with time, some ions can become autoresonant; ion oscillation frequencies become locked with the rf of the applied potentials, and autoresonant ion energies then increase with time.

Regarding oscillator systems more generally, a harmonic oscillator system may be described as a system which, when displaced from its equilibrium position, experiences a restoring force proportional to the displacement. If the linear restoring force is the only force acting on the system, the system becomes a simple harmonic oscillator, and it undergoes simple harmonic motion: sinusoidal oscillations about the equilibrium point, with constant frequency which does not depend on amplitude. Ions trapped in a harmonic potential well may experience linear fields and undergo simple harmonic motion oscillating at a fixed natural frequency that may depend only on the mass-to-charge ratio of the ions and the specific shape of the quadratic potential well (which is defined by the combination of the trap geometry and the magnitude of the electrostatic voltages). The natural oscillation frequency for a given ion trapped in a harmonic oscillator potential energy well may not be affected by its energy or the amplitude of oscillation and there is a strict relationship between natural frequency of oscillation and the square-root of mass-to-charge ratio, i.e., ions with a larger mass-to-charge ratio oscillate at a lower natural frequency than ions with a smaller mass-to-charge ratio. High-tolerance mechanical assemblies are generally required to establish carefully selected harmonic potential wells, self-bunching, isochronous oscillations and high resolution spectral output for both inductive pickup (FTMS) and TOF detection schemes.

Anharmonicity may be described as the deviation of a harmonic oscillator system, i.e., an oscillator that is not oscillating in simple harmonic motion is known as an anharmonic or nonlinear oscillator. In contrast to harmonic traps, this trap may utilize strong anharmonicity in the ion oscillatory motion as a means for (1) ion trapping and also for (2) mass-selective autoresonant excitation and ejection of ions. The natural frequency of oscillation of an ion in a potential well may depend on the amplitude of oscillation of an ion in such a potential well depends on the amplitude of oscillation frequency of a specific ion trapped in such a potential well may be determined by four factors: (1) the details of the trap geometry, (2) the ion's mass-to-charge ratio (m/q), (3) the ion's instantaneous amplitude of oscillation (related to its energy), and (4) the depth of the potential well may be defined by the voltage gradient established between electrodes, for example, and a central lens electrode. Indeed, in anharmonic oscillations, trapped ions will experience a decrease in natural oscillation frequency and an increase in oscillation amplitude of their energy increases.

In one aspect, the invention includes a method of operating a mass spectrometer to detect and analyze ions having an ion trap and utilizing ions confined within the ion trap, where the ions are confined with an anharmonic confining potential, and the ions oscillating at an initial natural oscillation frequency or frequencies. In preferred embodiments of the invention, the confining trap potential is electrostatic.

The ion trap may have at least four electrodes and, by applying two or more AC signals to more than two of the at least four electrodes, the two or more AC signals may be applied at the same instantaneous frequency. Alternatively, the two or more AC signals may be applied to at least two of the four electrodes. Moreover, the two or more AC signals may be applied at fixed relative phases and the two or more AC signals may have differing AC signal amplitudes. The AC signal amplitudes may exceed threshold values for autoresonant driving of the ions at an integer multiple of the initial natural oscillation frequency. The autoresonant driving may increase energies of ions and decrease natural oscillation frequencies below the initial natural oscillation frequency.

Additionally, the method of invention may include instantaneous frequency scanning which may comprise scanning from greater than the integer multiple of the initial natural oscillation frequency to less than the integer multiple of the initial natural oscillation frequency. The integer multiple (N) may be an integer multiple greater than 2. In certain methods, the integer multiple (N) is at least 4. In certain other methods, the integer multiple (N) is at least 6.

The two or more AC signals of the methods of the invention may achieve autoresonant driving of a proportion of the ions at N times the initial natural oscillation frequency. Further, fixed relative phases may be optimized for reduction of autoresonant ion driving at non-intended integer multiples of the natural oscillation frequencies, with the non-intended integer multiples being unequal to the integer multiple (N). The AC signal amplitudes may also be optimized for reduction of autoresonant ion driving at the non-intended integer multiples of the natural oscillation frequency.

Additionally, the AC signals of the method may be generated by an AC excitation source being connected to an AC network. Moreover, the AC signal amplitudes used in the methods of the invention and the fixed relative phases may generate an integer number of sections with instantaneously opposing AC electric field components within the ion trap, with the field components being components taken along the primary axis of confined ion oscillation, where the integer number may be greater than two. In certain embodiments, the integer number is equal to the integer multiple (N). In each oscillation cycle of the methods of the invention, each of the integer number of sections may drive changes of ion energies of similar magnitudes in autoresonantly driven confined ions.

The method of invention may also include mass scans that utilize detection of ions that are autoresonantly ejected from the ion trap. Moreover, mass scans may utilize processing of a signal that may be derived from motion of ions that have been autoresonantly driven and that remain within the ion trap. In other aspects, the AC signal amplitudes may be less than one hundredth of the confining potential.

For example, in a specific embodiment, the methods of the invention include the analysis of ions confined within an ion trap of a mass spectrometer. The trapped ions may have a natural oscillation frequency. The method may first include the step of confining the ions with an anharmonic confining potential within the ion trap, where the ion trap may have at least four electrodes. The method may further include the step of applying at least two AC signals to two or more of the at least four electrodes. The at least two AC signals may be different and may be applied at the same instantaneous frequency, at fixed relative phases, and at fixed AC signal amplitude differences. The method may also include the step of driving the ions with an AC signal and scanning at a frequency from above (or greater than) an integer multiple (N) of the natural oscillation frequency to below (or less than) the integer multiple (N) of the natural oscillation frequency. The integer multiple (N) is greater than two. Moreover, the method may include autoresonantly driving the ions with the AC signal with an amplitude that is greater than a threshold value for autoresonant driving of the ions at the integer multiple (N) of the natural oscillation frequency.

The present invention also includes a mass spectrometer that may utilize an ion trap and an AC excitation source, with the AC excitation source configured to provide an excitation frequency that excites confined ions at AC frequencies of about N times the natural oscillation frequency of the ions. The AC excitation source may be connected to at least two electrodes by an AC network providing more than one AC signal. Additionally, greater than two electrodes may be utilized with an AC network which may provide more than one AC signal. The ion trap may include an electrode structure that may produce an electrostatic confining potential in which ions are confined to trajectories at natural oscillation frequencies, with the confining potential being anharmonic. Moreover, the AC excitation source may have an excitation frequency that excites confined ions.

Regarding the AC excitation source and produced AC signal, each AC signal may have an AC signal amplitude and a fixed relative AC signal phase, with each AC signal being applied to a minimum of one of the electrodes. Each of the AC signal amplitudes and the AC signal phases may be chosen such that there are Y sections with instantaneously opposing AC electric fields within the ion trap, where Y is at least two, and that each of the Y sections contributes nearly equal amounts of energy to ion excitation. Thus, ion excitation may occur almost exclusively at AC frequencies of about N times the natural oscillation frequency of the ions. Additionally, the energies of the confined ions may be pumped autoresonantly and exclusively at AC frequencies of about N times the natural oscillation frequency of the ions. In certain aspects, Y may be an integer of greater than 2. Moreover, N may be an integer of greater than 2. Preferably, N is an integer of at least 4 or at least 6.

Regarding the application of autoresonance in the methods and devices of the invention, autoresonance may be considered the instantaneous ion oscillation frequency, $f_{osc}$, and must be a fraction of the applied rf frequency, $f_{rf}$. The ions can be driven autoresonantly only when the applied rf fields have $f_{rf}$ at an integer multiple of $f_{osc}$: either fundamental or harmonic frequencies. For sustained autoresonant driving the applied rf potential amplitudes must also exceed threshold amplitudes, i.e., amplitudes which are characteristics of the potential well depth, and anharmonicity, and the rate of rf reduction. Indeed, threshold amplitudes may be ejection threshold amplitudes, which may be the RF amplitudes at which a selected ion may be ejected from an ion trap.

When the rf frequency is scanned over a wide range from higher frequencies to lower, autoresonant ions can thus acquire enough energy to be ejected axially from the trap for collection at an ion detector. A mass spectrum thus attained, with autoresonant ion energy excitation is shown in FIG. 1. In this example, ion excitation and ejection is occurring when $f_{rf}$ is either $f_{osc}$ or 2 $f_{osc}$.

In the experiment of FIG. 1 an autoresonant ion trap of the design MS2 in reference [1] is utilized. A driving rf voltage, at $f_{rf}$, was applied to one side electrode of the trap only. Smaller, in phase, rf biases were also applied to other electrodes of the trap. An rf varying field extends throughout the whole volume of the trap, at the same phase. Trapped, oscillating ions thus experience both position and time dependent electric fields.

In this case the rf field is non-uniform, but importantly also (intentionally) asymmetric with respect to the middle electrode. Consequently, ion excitation and ejection can occur when $f_{rf}$ is either at the fundamental $f_{osc}$ or at 2 times $f_{osc}$. In the spectrum of FIG. 1 the harmonic driving is most clearly apparent in the ghosting of a mass 18 feature seen at an apparent mass of 18/4=4.5.

The probability of autoresonant excitation with $f_{rf}$ at twice the fundamental oscillation frequency is much lower than that for excitation at the fundamental frequency, $f_{osc}$. For normal operation of this trap mass spectrometer, an ion excitation at multiples of $f_{osc}$ is not a desirable phenomenon. Prolonged ion excitation at multiples off $f_{osc}$ generally can be eliminated by taking care to maintain the symmetry of the trap potentials and by the use of lower applied rf voltages, thus keeping the harmonic field amplitudes below autoresonant threshold levels.

Figure 2:
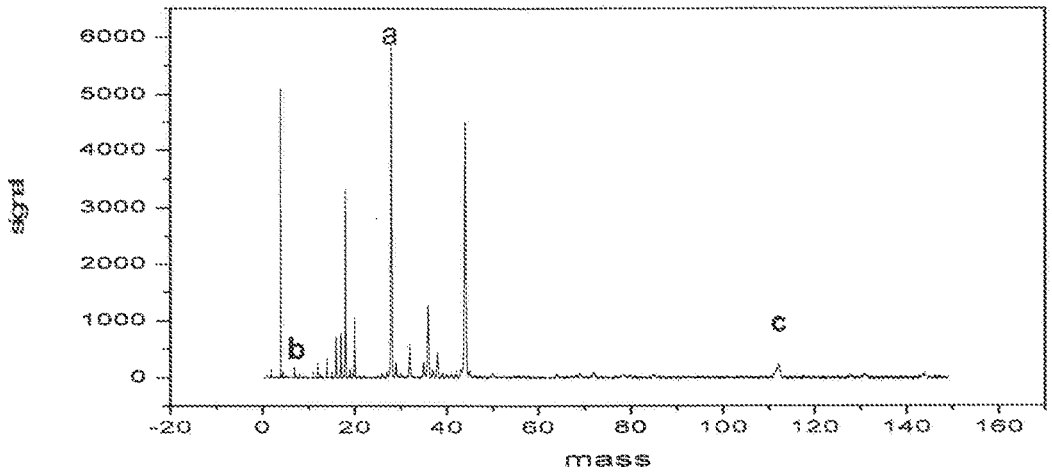
FIG. 2 illustrates a mass spectrum showing autoresonant excitation by application of an rf potential at twice the fundamental oscillation frequency, with evidence of weaker excitations at the fundamental frequency and at four times the fundamental frequency; where mass 28 (a) is highlighted also at ¼ (b) and 4 times (c) of its actual mass. The ion ejection rf to mass conversion has been renormalized to identify the largest 2× excitation features at the correct corresponding ion masses.

Alternatively, parametric autoresonant ion excitation may be utilized. In this scenario an rf bias may be applied to the middle electrode of a trap with near mirror reflection symmetry. The rf field should be purely odd with respect to the middle electrode plane. The rf field direction in one half of the trap is instantaneously 180° phase-shifted with respect to the rf field in the mirrored half. If the rf frequency is at twice the ion oscillation frequency, and the rf phase is such that an ion is accelerated in one half of the trap, then the ion would be accelerated in all of the trap following ¼ periods. As a result, the predominant ion excitation and ejection occurs when $f_{rf}=2\ f_{osc}$. The ion energy excitation with $f_{rf}$ at twice $f_{osc}$ is thus much stronger than excitation at other integer multiples of $f_{osc}$. A mass spectrum with enhanced excitation at twice the fundamental frequency is shown in FIG. 2.

For optimal operation of the foregoing trap mass spectrometer, ion excitation at multiples other than twice $f_{osc}$ is not desirable. In this sense spectra can be again improved by maintaining the symmetry of the trap potentials and by careful implementation of specific symmetric rf field functions. Under normal operation the relative reduction of these features rely on the use of lower applied rf voltages, and the maintenance of the higher harmonic field amplitudes below autoresonant threshold levels.

The present invention provides autoresonant excitation of ions with radio frequencies exclusively at selected multiples that are greater than twice the fundamental ion oscillation frequencies providing distinct advantages over the above referenced devices and methods in the field.

While the normal practice has been to remove higher multiple harmonic radio frequency fields, their presence can be beneficial. Generally, the N times (integer multiple greater than, or equal to, two) harmonic fields can be brought about intentionally by separating the trap into N regions of adjacent reversed rf fields. In that manner N separated autoresonant ion packets can be driven simultaneously. Each autoresonant ion will experience nearly identical fields over the course of each complete oscillation in the trap. All ions from the N ion packets will be ejected from the trap nearly simultaneously and will produce N times stronger signals (assuming all other ejection conditions are similar). The presence of fields with multiple harmonics of $f_{osc}$ can be beneficial also as the phase difference between the driving rf at $f_{rf}$, (near $Nf_{osc}$) and ion oscillation harmonics at N $f_{osc}$, changes N times faster than with excitation at the fundamental frequency alone for the same rate of scanning across sequential ejected masses. Therefore, the success of autoresonant ion excitation becomes N times more sensitive to differences in the $f_{rf}$ and $Nf_{osc}$, and consequently higher mass resolution can be achieved at the same mass scan rates.

In order to achieve clean spectra by driving at higher harmonics (with spectra that are free from peaks generated with $f_{rf}$ at rational fractions or unwanted harmonics of $f_{osc}$) it is necessary to create conditions such that excitation at a desired $N^{th}$ harmonic is much stronger than excitation at all other harmonics. This requirement is addressed below.

In the common manifestations of autoresonant ion trap mass spectrometers the ions within the trap experience axially symmetric DC and rf fields. To good approximation also the ion traps are symmetric about a z=0 mid-plane and the DC potentials are symmetric about the mid-plane. At an instant of applied maximum rf potentials we define the position sensitive rf field (force per unit ion charge) as given by an amplitude function, $\underline{A}_{rf}(z, R)$. On the axis of cylindrical symmetry the amplitude function will be purely axial, in either positive or negative directions. We define also the axial amplitude function, $A_{rfo}(az)=+/-|\underline{A}_{rf}(z, R=0)|$ where the sign is determined by the local direction of the rf field.

(a) If rf biases are applied symmetrically about the mid plane, then the axial amplitude function, $A_{rfo}(z)$, is asymmetric (odd) about the mid plane.

(b) For rf potentials which are purely asymmetric with respect to the mid plane, $A_{rfo}(z)$ is then even about the mid plane.

If a trapped ion is taken to oscillate about the mid plane with a period τ, following a periodic trajectory z(t) then the local field amplitude experienced by such an ion is necessarily periodic in time, and $$\text{for case } (a)\ A_{rfo}(z(t))=\Sigma\alpha_{rfom}\cos(2\pi m f_{osc}(t-\tau/4)).$$

The timing here is chosen such that the ion is at $-z_o$ at t=0, and is at the mid plane of the trap at one quarter of the full period of oscillation, τ, where $\tau=1/f_{osc}$.

The sum is made over all positive integers, m. The exact $\alpha_{rfom}$ Fourier coefficients are dependent on the geometry of the trap, the ion energy, the DC potentials applied, and the magnitudes of applied rf potentials.

$$\text{For } (b)\ A_{rfo}(z(t))=\Sigma b_{rfom}\sin(2\pi m\, f_{osc}(t-\tau/4)).$$

At any instant the kinetic energy of an ion changes as a result of the field applied to the ion. During the course of a complete cycle the net effect of the DC fields on the ion's energy is necessarily zero. Time dependent contributions, however, can influence the total energy of the particle. If the rf fields are modulated with a frequency $f_{rf}$, then at any instant $$dE_{rf}/dt=A_{rfo}(t)\sin(f_{rf}t+\phi)v(t),$$

where v(t) represents the time dependent ion velocity, which is itself a periodic function of time. The change in ion energy, i.e., the time integral of this differential, can remain positive and increasing over prolonged periods (of many oscillations) if and only if $f_{rf}\sim Nf_{osc}$. The time integral of $dE_{rf}/dt$ over one oscillation period is largest with φ=0. The energy of an autoresonant ion increases continually and does so with a motion that is phase locked with the driving rf fields. Such an ion can remain phase locked and thus be driven to still higher energies, finally enabling ejection of ions from the trap.

For prolonged autoresonance in a trap of case (a) allowable harmonics (N numbers) are necessarily even only. For autoresonance in a trap of case (b) allowable harmonics are necessarily odd only.

Enhanced ion excitation at an $N^{th}$ harmonic and suppression of other harmonic terms can be achieved when the instantaneous direction of the rf field within the trap reverses its direction (N−1) times along an extended half cycle of an ion trajectory, i.e., there should be N segments within the trap with opposing rf field directions. To most effectively reduce both higher-, and lower-, harmonic autoresonant pumping, the length of each segment should be such that the transit time of an ion through each segment is approximately equal, that is 1/(2N) of the entire ion oscillation period, τ. If the rf frequency is N times higher than the ion oscillation frequency then the rf field oscillates through ½ period while an ion moves through one segment only. The instantaneous differential, $dE_{rf}/dt$ can remain positive at all times of the full ion oscillation, i.e., at all times during N rf period oscillations. Therefore, if the rf contribution of the local potential fields is to accelerate an ion in one segment it will continue in the same sense (acceleration) in all remaining segments. For parametric (N=2) driving (when an rf potential need only be applied to one mid electrode alone) the above conditions may be automatically fulfilled. For N=3 and above, however, more careful consideration should be made of the applied rf biases on two or more electrodes.

The following examples describe the invention in further detail. These examples are provided for illustrative purposes only, and should in no way be considered as limiting the invention.

EXAMPLES

Example 1

Figure 3:
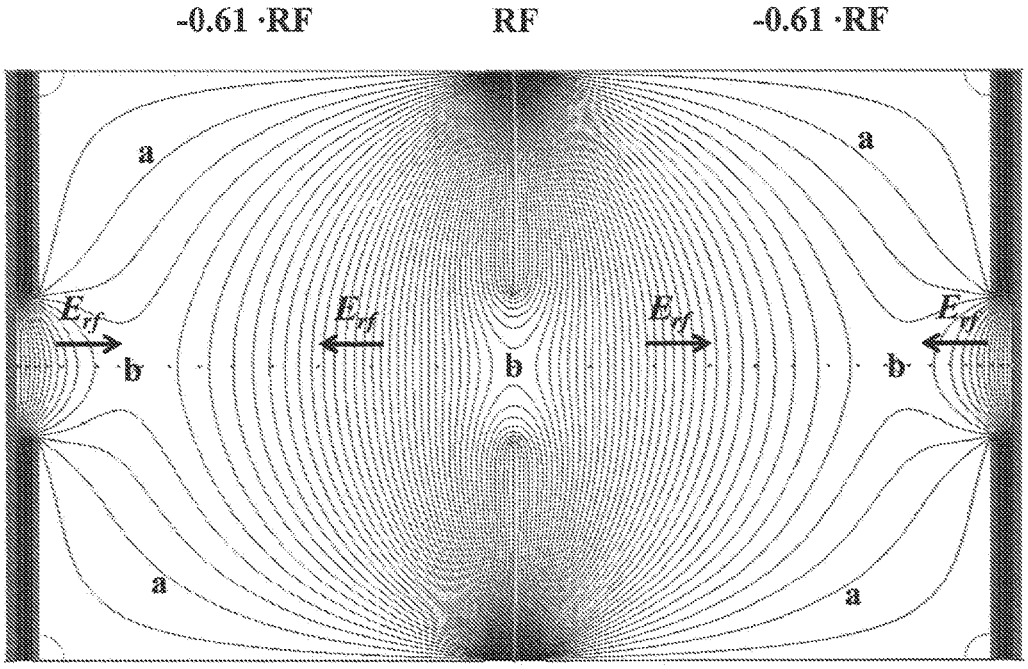
FIG. 3 illustrates an electrostatic ion trap with closely spaced compensation electrodes. An rf voltage is applied to the central electrode and −0.61 times the same rf voltage is applied to the cup shaped electrodes. The field lines (a) demonstrate the rf field equipotentials, saddle points (b) of the rf field are marked, dots are equally spaced time markers on an axial ion trajectory; and the $E_{rf}$ arrows indicate the direction of the rf field at an instant of the applied rf field.

An exemplary implementation of an ion trap of the invention, with N=4 and Y=4, is demonstrated in FIG. 3.

An rf bias voltage, $V_{RFmid}$, is applied to the middle electrode and an rf voltage, $V_{RFce}$, is applied to the cup electrodes of an ion trap spectrometer where $V_{RFce}=-0.61\cdot V_{RFmid}$. Importantly the two biases are inverted with respect to one another. The rf field in the trap has 3 saddle points along the trap axis: one in the middle and two within the cup electrodes. Two saddle points are indicated at b in FIG. 3 having near-zero equifield lines. The third saddle point b lies at the very center of the trap. By design the ion travel time from an end electrode to a saddle point closely matches that from the saddle point to the center of the trap; the same number of time markers are traversed between turn around points (points of zero velocity) and points of near zero rf field strengths. In this way the autoresonant drive function, $A_{rfo}(t)\ v(t)$, most closely resembles a simple sinusoidal function in time with a period=1/(4 $f_{osc}$). At the end of one rf oscillation period there is a net increase of energy of an auto resonant ion, resonant with an applied rf at $f_{rf}=f_{osc}$. An optimal pure sinusoid character would ensure coupling with only the intended harmonic and virtually no coupling with other harmonic frequencies.

Figure 4:
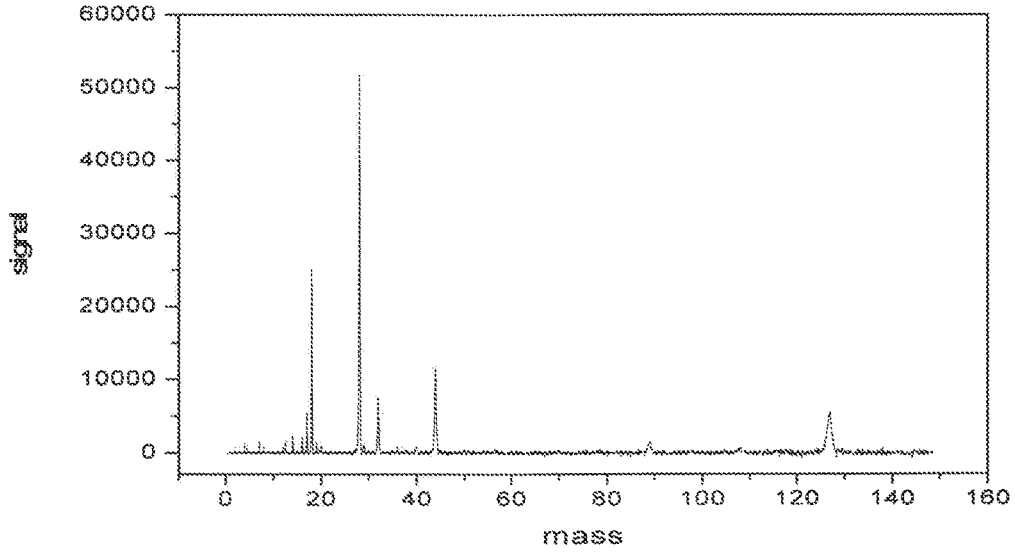
FIG. 4 illustrates a mass spectrum of an air leak and $SF_6$ (monitored at mass 127) showing exclusive autoresonant excitation at a selected rf of four times the fundamental frequency, taken at $3.10 \cdot 10^{-9}$ Torr total pressure; scan parameters are listed here, where with a scan rate of 15 scans/second, center plate voltage of −470 V, cup voltage each −10 V, 100 mV rf applied to the middle plate and −61 mV rf applied to the cups, and data averaging time of 3 minutes.

The above trap configuration was tested on a compensated autoresonant mass spectrometer. A mass spectrum is shown in FIG. 4, demonstrating exclusive autoresonant excitation at a selected rf of four times the fundamental oscillation frequency. $SF_6$ gas was introduced into the vacuum chamber to obtain peaks at higher masses for a more accurate measurement of instrumental mass resolution.

Figure 5:
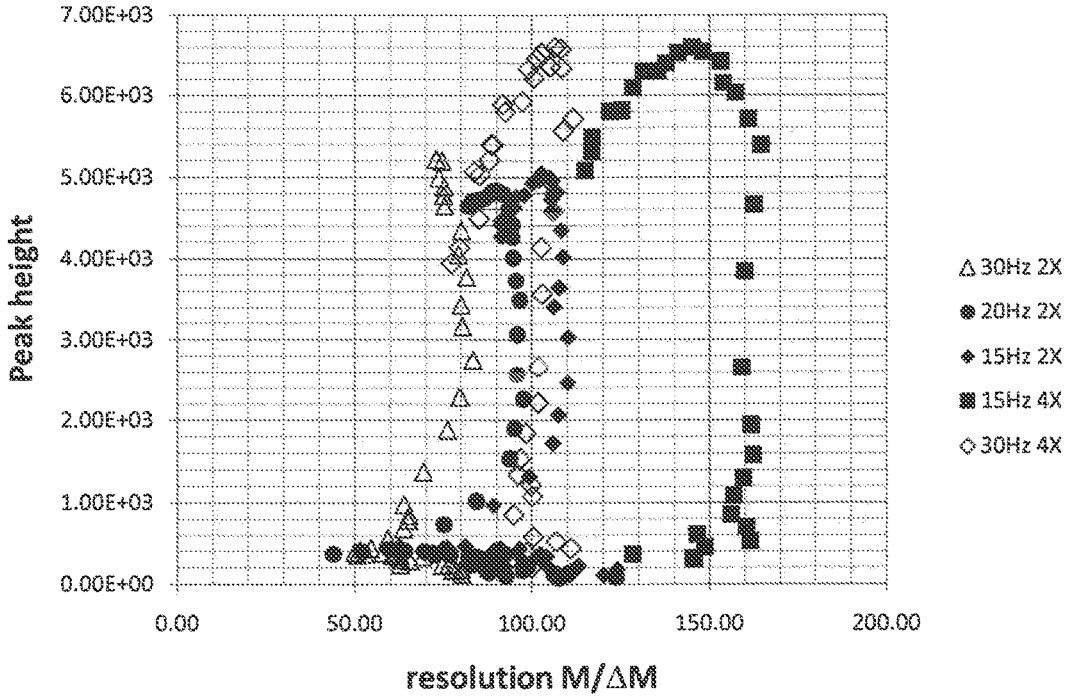
FIG. 5 graphically illustrates parametric plots of peak height of mass 28 vs. resolution, with the rf voltages as a parameter, taken at different scan rates.

The same trap was configured in two modes: for autoresonant excitation at a selected rf of four times (4×) and at twice (2×) the ion oscillation frequency. Multiple scans were performed at different scan rates and different rf voltages. FIG. 5 shows parametric plots of averaged heights of mass 28 peaks vs. peak resolution. The rf voltage parameter varies from 40 mV to 400 mV, and scan rates of 15, 20, and 30 scans/second were used. This plot shows an advantage of excitation at an rf of four times the ion oscillation frequency over excitation at an rf of two times the ion oscillation frequency. Operation with the 4× mode and at a scan rate of 15 scans/second achieves approximately a 50% better maximum resolution factor and a 30% better peak height than operation with the 2× mode and at the same scan rate. Operation with 4× mode and at a scan rate of 30 scans/second demonstrates the similar resolutions but at higher peak amplitudes compared to those seen for the 2× mode. Consequently the 4× mode and double the scan rate will enable the same signal to noise ratios in less than 50% of the time required for 2× mode scans.

Example 2

Figure 6:
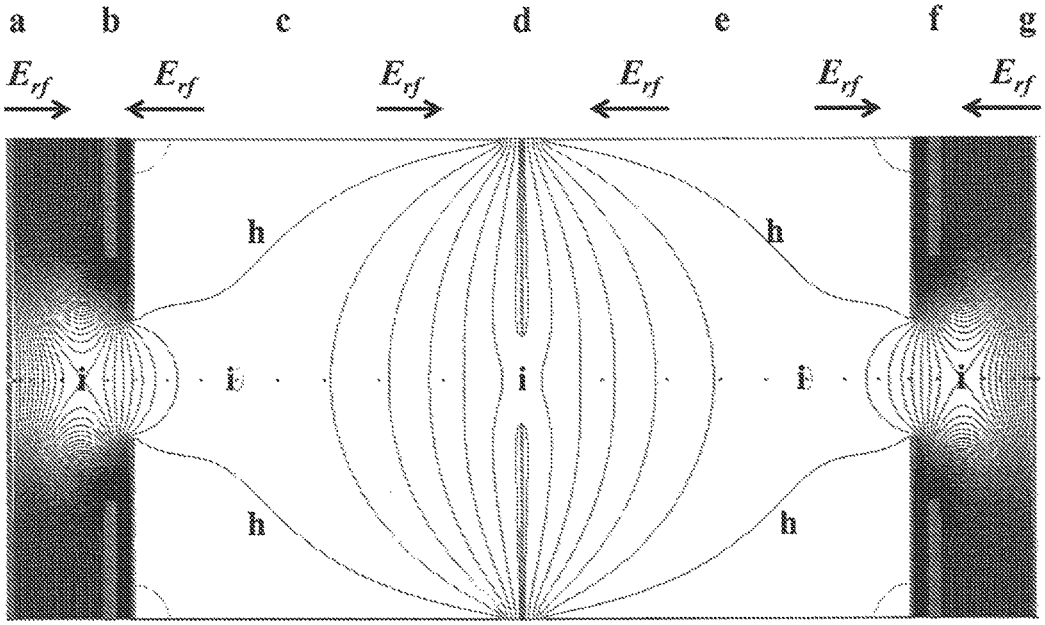
FIG. 6 illustrates an electrostatic ion trap with additional excitation electrodes (b, f). Relative rf voltages are applied to electrodes: at (b) 100%, (c) 3%, (d) 11.5%, (e) 3%, and (f) 100%. The field lines (h) are the rf field equipotentials, saddle points (i) of the rf field are marked, dots are equi-separated time markers on an axial ion trajectory; and the local directions of instantaneous applied $E_{rf}$ fields are indicated.

For exclusive autoresonant excitation at a selected rf of six times the ion oscillation frequency (6× mode) we used a trap (with N=6 and Y=6) with additional excitation electrodes, as shown in FIG. 6. Relative rf voltages are applied to the electrodes: (b) at 100%, (c) 3%, (d) 11.5%, (e) 3%, and (f) 100%. The rf field in the trap has 5 saddle points (6 segments) along the trap axis: one in the middle, two within the cup electrodes and two between the cup\ electrodes and end plates. Two saddle points are marked at i having near-zero equifield lines. The travel time of an ion from the side electrode to the outer saddle point equals those from the outer saddle point to the inner saddle point, and from the inner saddle point to the center of the trap (as indicated by the same number of time markers). In practice the rf voltages and phases, applied to the electrodes b, c, d, e, f, are adjusted further following the initial ion trap operation in order to virtually eliminate ion excitation at all unintended harmonic frequencies.

The same trap has been configured also for exclusive excitation at an rf of four times (4× mode), and two times (2× mode) of the ion oscillation frequency, and for operation at the fundamental frequency (1× mode). The rf and DC voltages applied to the trap in each configuration are summarized in Table 1.

TABLE 1

DC voltages and rf voltage scaling factors.

| | electrode | | | | | | |
|---|---|---|---|---|---|---|---|
| Mode | a | b | c | d | e | f | g |
| 1x | 0 | 0.65 | 0.65 | 1 | 0.65 | 0.65 | 1 |
| 2x | 0 | 0.4 | 0.4 | 1 | 0.4 | 0.4 | 0 |
| 4x | 0 | 0.4 | 0.4 | −1 | 0.4 | 0.4 | 0 |
| 6x | 0 | 1 | 0 | 0.3 | 0 | 1 | 0 |
| DC (V) | 134 | 69 | 27 | −685 | 27 | 69 | 125 |

Figure 7:
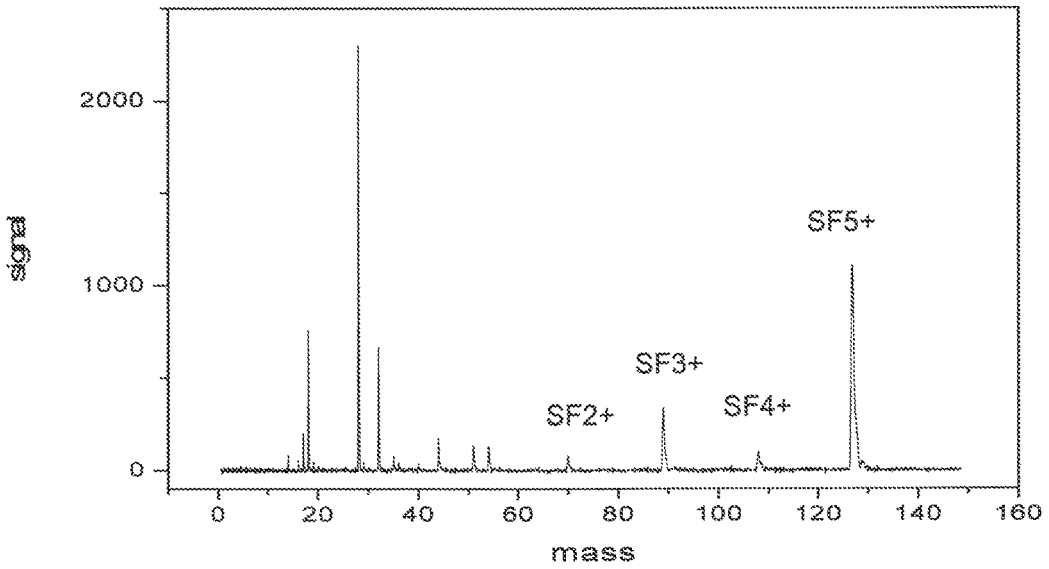
FIG. 7 illustrates a mass spectrum of air with $SF_6$ at $4.10 \cdot 10^{-9}$ Torr total pressure. Ions are excited autoresonantly at solely an rf of six times higher than the ion oscillation frequencies; no evidence for excitation at other multiples is observed in this spectrum; with an rf amplitude 177 mV; scan rate of 15 scans/sec.; and averaging time of 3 min.

All configurations were tested at a total pressure of $4\cdot10^{-9}$ Torr. A mass spectrum with exclusive autoresonant excitation at an rf of six times the fundamental frequency (6× mode) is shown in FIG. 7.

Figure 8:
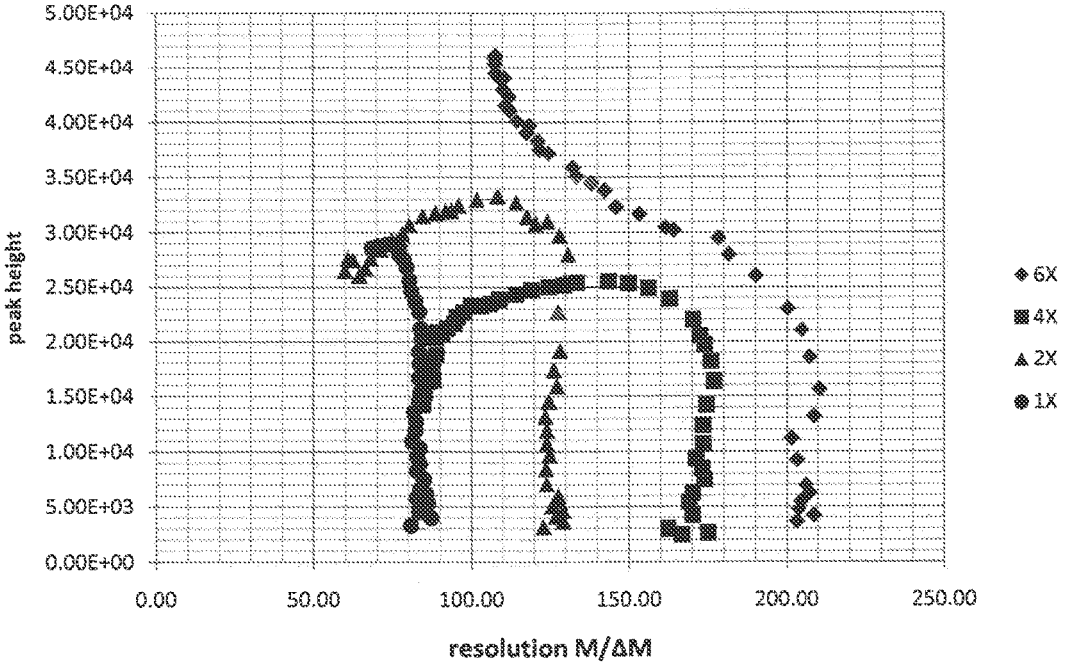
FIG. 8 graphically illustrates parametric plots of mass 127 peak heights vs. mass resolution, taken with varying rf bias amplitudes, and at different multiples of ion oscillation frequency.

Multiple spectra of air and $SF_6$ at $4\cdot10^{-9}$ Torr total pressure were acquired at different scan rates, at different rf voltage amplitudes, and with different modes of operation. Spectra were averaged until signal to noise ratio reached 100 or until the averaging time reached 3 minutes. FIG. 8 shows parametric plots of peak height of mass 127 vs. resolution, with the rf voltage as a parameter varying from 60 mV to 360 mV. Spectra were acquired with the mass spectrometer configured for operation at the fundamental, at twice, four times, and six times the ion oscillation frequency; i.e, respectively with 1×, 2×, 4×, and 6× modes. Parametric plots clearly show that spectra acquired at higher (Nx) harmonics have higher resolution at the same peak heights and higher peaks at similar resolution than spectra acquired at lower harmonics.

Figure 9:
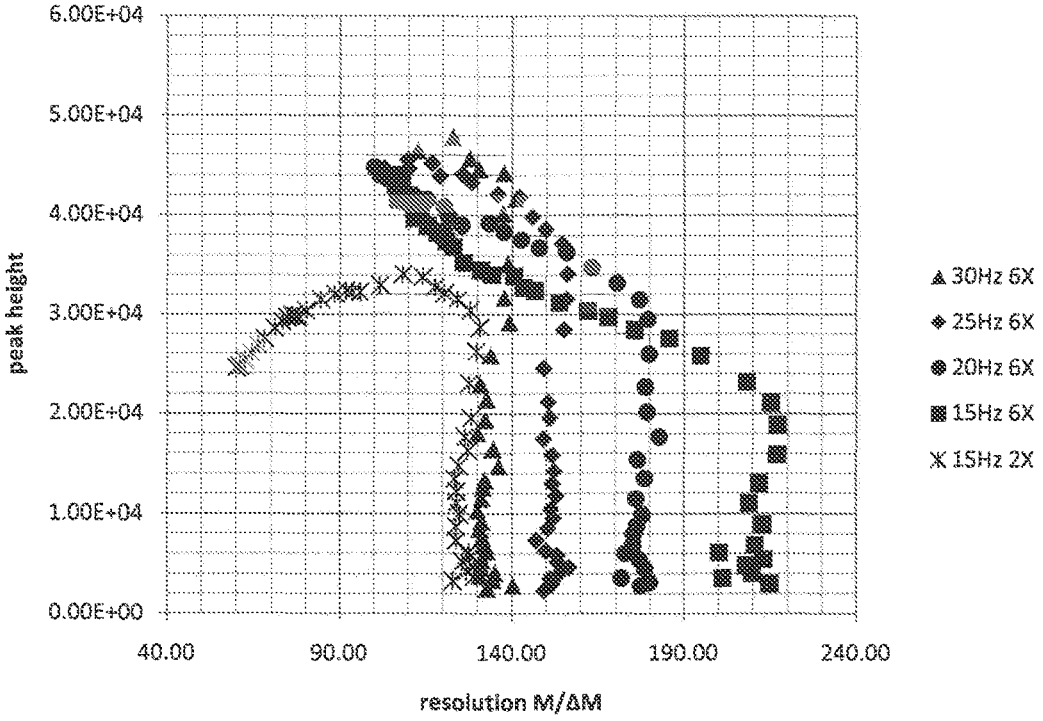
FIG. 9 graphically illustrates parametric plots of mass 127 peak height vs. mass resolution, taken at different scan rates in the 6× and 2× modes.

Further parametric plots of mass 127 peak height vs. mass resolution are shown in FIG. 9. Comparisons are made for 6× and 2× modes, taken at scan rates of 15, 20, 25, and 30 scans/second. The plots disclosed herein clearly show advantages of excitation at an rf of six times the ion oscillation frequency vs. excitation at two times the ion oscillation frequency. Operation in the 6× mode and at a scan rate of 15 scans/second achieves 70% better resolution than operation in the 2× frequency mode at the same scan rate. Operation in the 6× mode and at a scan rate of 30 scans/second still has better resolution, and 50% higher peak amplitudes, than was shown in 2× scans. The implication is that the 6× mode with double the scan rate enables comparable signal to noise ratio and improved resolution to be attained in less than half of the time that is required for 2× mode scans. Data taking rates can thus be easily doubled with implementation of this new higher-harmonic mode of autoresonant mass spectrometry.

Figure 10:
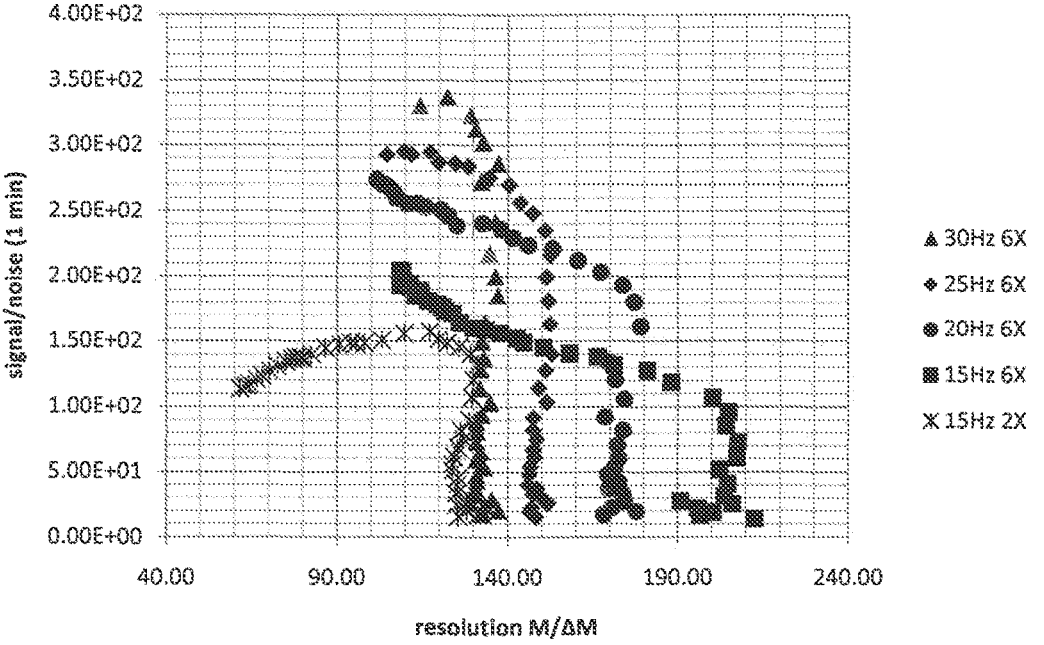
FIG. 10 graphically illustrates parametric plots of mass 127 peak signal to noise ratios attained in 1 minute vs. mass resolution, with varying rf voltage amplitudes, taken at different scan rates in the 6× and 2× operation modes.

The viability of increased data taking rates with higher-harmonic modes is demonstrated most clearly in FIG. 10. The plots show signal to noise ratios for the mass 127 peaks integrated over 1 minute. For comparable resolutions, at 120 or below, the 6× mode at 30 scans/second shows more than double the signal to noise ratio shown with 2× operation at 15 Hz using the same data collection time. For comparable signal to noise ratios, at the same scan rate, the 6× mode shows up to twice the mass resolution of the 2× mode. Lastly, operation at higher scan rates also allows for a more rapid minimum response time of the instrument. A response time as low as 33 ms has been demonstrated here.

We have demonstrated electrostatic ion trap mass spectrometers, and methods of operating such spectrometers, in which ions are autoresonantly driven at selected higher integer (>2) multiples of ion oscillation frequencies. Excitation at multiples higher than the fundamental or double the fundamental ion oscillation frequency significantly improves both signal intensity and mass resolution. The method allows excitation exclusively at one selected frequency that is an integer multiple of an ion's natural oscillation frequency, and thereby virtually eliminates ion excitation at unwanted harmonic frequencies. The resultant mass spectra are therefore clean, and do not display spectral features associated with rf excitation at unintended multiple harmonic frequencies. This has been demonstrated explicitly for 4× and 6× modes, and we have deduced it is fully implementable at any odd or even multiples of ion oscillation frequencies. With implementation of the method, mass spectrometers can be operated at faster mass scan rates, giving faster response times, without degradation of signal to noise or resolution over the existing technology instruments.

A number of patent and non-patent publications are cited herein in order to describe the state of the art to which this invention pertains. The entire disclosure of each of these publications is incorporated by reference herein.

While certain embodiments of the present invention have been described and/or exemplified above, various other embodiments will be apparent to those skilled in the art from the foregoing disclosure. The present invention is, therefore, not limited to the particular embodiments described and/or exemplified, but is capable of considerable variation and modification without departure from the scope and spirit of the appended claims.

Moreover, as used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Furthermore, the transitional terms "comprising", "consisting essentially of" and "consisting of," when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinarily associated with the specified material(s). The term "consisting essentially of" limits the scope of a claim to the specified elements, steps or material(s) and those that do not materially affect the basic and novel characteristic(s) of the claimed invention. All devices and methods described herein that embody the present invention can, in alternate embodiments, be more specifically defined by any of the transitional terms "comprising," "consisting essentially of," and "consisting of."

REFERENCES

[1] "An electrostatic autoresonant ion trap mass spectrometer", A. V. Ermakov, B. J. Hinch, Rev. Sci. Instrum. 81 (2010) 013107.

[2] "Trajectory compensation in an autoresonant trap mass spectrometer", A. V. Ermakov, B. J. Hinch, J. Mass Spectrometry. 46 (2011) 672.

[3] "Autoresonant Trap Mass Spectrometry (ART MS) for remote sensing applications", Int. J. Mass Spectrometry 295, (2010), 133.

[4] U.S. Pat. No. 8,586,918 B2 Nov. 19 (2013) Brucker et al., "Electrostatic Ion Trap."

What is claimed is:

1. A mass spectroscopic method utilizing ions having an initial natural oscillation frequency confined within an ion trap, the method comprising the steps of:

a) confining the ions with an anharmonic confining potential within the ion trap, wherein the ion trap comprises at least four electrodes;

b) applying at least two AC signals to more than two of the at least four electrodes at the same instantaneous frequency and at fixed relative phases, but differing in AC signal amplitudes, to generate an integer number of Y sections with spatially adjacent sections having instantaneously opposing AC electric fields within the ion trap, wherein the integer number Y comprises an integer of at least 3;

c) autoresonantly driving the ions with an AC signal amplitude that is greater than a threshold value at an integer multiple of the initial natural oscillation frequency and at a frequency less than the integer multiple of the initial natural oscillation frequency; and d) scanning the instantaneous frequency from greater than the integer multiple of the initial natural oscillation frequency to less than the integer multiple of the initial natural oscillation frequency, wherein the integer multiple is greater than 2.

2. The method according to claim 1, wherein the anharmonic confining potential is electrostatic.

3. The method according to claim 1, wherein the at least two AC signals are generated by an AC excitation source.

4. The method of claim 1, wherein the AC electric field components are taken along a primary axis of confined ion oscillation.

5. The method according to claim 1, wherein the method comprises an oscillation cycle.

6. The method according to claim 1, wherein the each of the integer number of Y sections drives changes of ion energies of similar magnitudes in autoresonantly driven confined ions.

7. The method according to claim 1, comprising processing a signal derived from the motion of ions that have been autoresonantly driven and that remain within the ion trap.

8. The method according to claim 1, wherein the AC signal amplitudes are less than one hundredth of the anharmonic confining potential.

9. The method according to claim 1, further comprising the step of obtaining a mass spectrum by detecting ions that are autoresonantly ejected from the ion trap.

10. The method according claim 1, wherein the integer multiple is at least 4.

11. The method according to claim 1, wherein the integer multiple is at least 6.

12. The method according to claim 1, wherein the integer multiple comprises an even integer.

13. The method according to claim 1, wherein the integer multiple comprises an odd integer.

14. A mass spectrometer comprising:

a) an ion trap comprising an electrode structure that is configured to produce an electrostatic confining potential that is anharmonic, the electrode structure configured to confine ions to trajectories at natural oscillation frequencies; and b) an AC excitation source configured to provide an excitation frequency that excites confined ions at AC frequencies of about N times the natural oscillation frequency of the ions; the AC excitation source being connected to at least four electrodes by an AC network and capable of providing at least two AC signals; the at least two AC signals having the same instantaneous frequency, different AC signal amplitudes and fixed relative AC signal phases; the at least two AC signals being applied to more than two of the at least four electrodes; wherein the AC signal amplitudes and the AC signal phases are selected such that there are Y sections with spatially adjacent sections having instantaneously opposing AC electric fields within the ion trap, with each of the Y sections contributing about equal amounts of energy to ion excitation; wherein N is an integer greater than two and Y is an integer of at least three.

15. The mass spectrometer of claim 14, wherein the AC excitation source is configured to autoresonantly pump the energies of the confined ions at an AC frequency of about N times the natural oscillation frequency of the ions.

16. The mass spectrometer according to claim 14, wherein Y is 4 or 6.

17. The mass spectrometer according to 19, wherein N is an integer of at least 4.

18. The mass spectrometer according to claim 14, wherein N is an integer of at least 6.

19. The mass spectrometer according to claim 14, that is configured to process a signal derived from motion of ions that have been autoresonantly driven and that remain within the ion trap.

20. The mass spectrometer according to claim 14, wherein the AC signal amplitudes are less than one hundredth of the anharmonic confining potential.

21. The mass spectrometer according to claim 14, that is configured to produce mass spectra obtained by detecting ions that are autoresonantly ejected from the ion trap.

* * * * *